US011361957B2

(12) United States Patent
Izumi

(10) Patent No.: US 11,361,957 B2
(45) Date of Patent: Jun. 14, 2022

(54) TIME-OF-FLIGHT MASS SPECTROMETER AND PROGRAM

(71) Applicant: SHIMADZU CORPORATION, Kyoto (JP)

(72) Inventor: Hideaki Izumi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 293 days.

(21) Appl. No.: 16/532,630

(22) Filed: Aug. 6, 2019

(65) Prior Publication Data

US 2020/0051804 A1 Feb. 13, 2020

(30) Foreign Application Priority Data

Aug. 8, 2018 (JP) ..... JP2018-149773

(51) Int. Cl.
*H01J 49/40* (2006.01)
*H01J 49/06* (2006.01)
*H01J 49/42* (2006.01)

(52) U.S. Cl.
CPC ..... *H01J 49/401* (2013.01); *H01J 49/063* (2013.01); *H01J 49/4215* (2013.01)

(58) Field of Classification Search
CPC .. H01J 49/004; H01J 49/0036; H01J 49/0063; H01J 49/0072; H01J 49/0081; H01J 49/4215; H01J 49/4225; H01J 49/4265
See application file for complete search history.

(56) References Cited

U.S. PATENT DOCUMENTS

2003/0222211 A1 12/2003 Okumura et al.
2004/0217272 A1* 11/2004 Horning ..... H01J 49/4265 250/281
2011/0315868 A1 12/2011 Hirabayashi et al.
2016/0093482 A1 3/2016 Campbell et al.
2018/0218893 A1 8/2018 Shiohama

FOREIGN PATENT DOCUMENTS

JP 2003-346704 A 12/2003
JP 2007-046966 A 2/2007
WO 2017/017787 A1 2/2017

OTHER PUBLICATIONS

Communication dated Dec. 20, 2019 by the European Patent Office in application No. 19185965.1.
Notice of Reasons for Refusal dated Dec. 21, 2021 from the Japanese Patent Office in JP Application No. 2018-149773.
Office Action dated Mar. 28, 2022, issued in Chinese Application No. 201910730755.X.

* cited by examiner

*Primary Examiner* — David E Smith
*Assistant Examiner* — Hsien C Tsai
(74) *Attorney, Agent, or Firm* — Sughrue Mion, PLLC

(57) ABSTRACT

A time-of-flight mass spectrometer includes a flight tube, an ion introduction unit that is connected to the flight tube, an ion detector that detects an ion flown in the flight tube, and a control unit that controls the ion introduction unit and the flight tube, wherein: the control unit sequentially changes an accumulation state of the ion to be introduced into the flight tube by the ion introduction unit, for a plurality of measurement processes performed repeatedly.

13 Claims, 7 Drawing Sheets

TIME-OF-FLIGHT MASS SPECTROMETER AND PROGRAM

INCORPORATION BY REFERENCE

The disclosure of the following priority application is herein incorporated by reference: Japanese Patent Application No. 2018-149773 filed Aug. 8, 2018.

TECHNICAL FIELD

The present invention relates to a time-of-flight mass spectrometer and a program.

BACKGROUND ART

In a time-of-flight mass spectrometer (hereinafter sometimes referred to as TOFMS), constant kinetic energy is given to ions to be analyzed, and ions are introduced into a flight space formed in the flight tube so that the ions fly in the flight space. Then, a time required for each ion to fly a certain distance is measured, and a mass-to-charge ratio (m/z) of each ion is calculated based on the flight time. In addition, in a time-of-flight mass spectrometer, a method is proposed in which ions to be analyzed are accumulated in an ion trap before being introduced into a flight tube, and the number of ions to be analyzed is increased to improve a measurement accuracy (see PTL1).

CITATION LIST

Patent Literature

PTL1: WO2017/017787

SUMMARY OF INVENTION

Technical Problem

Because an analysis target of the time-of-flight mass spectrometer is a charged ion, the measurement accuracy may be reduced due to so-called space-charge effect as the number of ions introduced into the spectrometer increases. For a currently required measurement accuracy, the influence of space-charge effect is not problematic. However, in the future, it is necessary to further increase the number of ions and further increase a flight distance in a flight tube in order to realize a mass spectrometer having a higher accuracy and a higher resolution. As a result, the space-charge effect has an increased influence to an extent that the space-charge effect cannot be ignored.

Solution to Problem

A time-of-flight mass spectrometer according to the 1st aspect comprising: a flight tube; an ion introduction unit that is connected to the flight tube; an ion detector that detects an ion flown in the flight tube; and a control unit that controls the ion introduction unit and the flight tube, wherein: the control unit sequentially changes an accumulation state of the ion to be introduced into the flight tube by the ion introduction unit, for a plurality of measurement processes performed repeatedly.

A non-transitory computer-readable recording medium, according to the 2nd aspect, on which is recorded a program that controls a time-of-flight mass spectrometer, the program being configured to cause a data processor including a computer to perform a control of sequentially changing accumulation states of ions introduced from the ion introduction unit into the flight tube for a plurality of measurement processes performed repeatedly.

Advantageous Effects of Invention

According to the present invention, it is possible to realize a time-of-flight mass spectrometer having a high accuracy and a high resolution with a reduced adverse influence due to the space-charge effect.

BRIEF DESCRIPTION OF DRAWINGS

FIG. 3(*a*) shows a measurement result in a case where the transport efficiency is low; FIG. 3(*b*) shows a measurement result in a case where the transport efficiency is medium; and FIG. 3(*c*) shows a measurement result in a case where the transport efficiency is high.

DESCRIPTION OF EMBODIMENTS

First Embodiment of Time-of-Flight Mass Spectrometer

Figure 1:
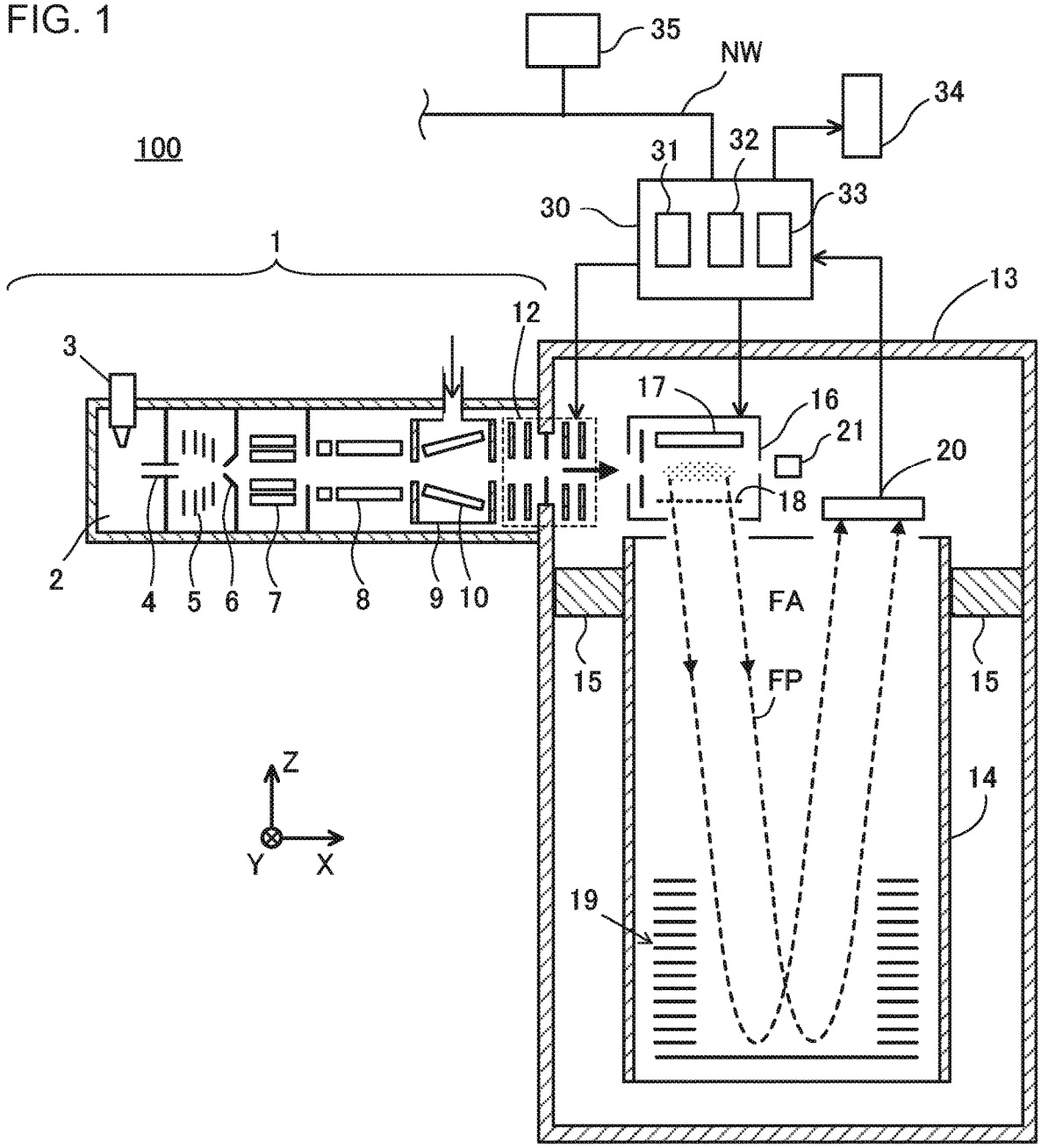
FIG. 1 is a view showing a configuration of a time-of-flight mass spectrometer according to a first embodiment.

FIG. 1 is a conceptual view showing a configuration of a time-of-flight mass spectrometer 100 of a first embodiment. The time-of-flight mass spectrometer 100 includes an ion introduction unit 1, a vacuum chamber 13 connected to the ion introduction unit 1, and a flight tube 14 provided in the vacuum chamber 13.

An ionization chamber 2 in the ion introduction unit 1 is provided with an ESI spray 3 for performing electrospray ionization (ESI) as an ion source. When a sample liquid containing a component to be analyzed is supplied to the ESI spray 3, the ESI spray 3 electrostatically sprays the sample liquid to generate ions derived from the sample in the sample liquid. Note that the ionization method is not limited to this.

Various types of ions generated in this way pass through a heating capillary 4 and they are then converged by an ion guide 5 to reach an octupole ion guide 7 through a skimmer 6. Ions converged by the ion guide 7 are introduced into a quadrupole mass filter 8, and only an ion having a specific mass-to-charge ratio corresponding to a voltage applied to the quadrupole mass filter 8 passes through the quadrupole mass filter 8. This ion is referred to as a precursor ion. The precursor ion is introduced into a collision cell 9 provided with a multipole ion guide 10. In the collision cell 9, the precursor ion dissociates due to collision with an externally supplied CID gas to generate various types of product ions.

Various types of product ions generated in the collision cell 9 are guided by an ion transport optical system 12 and introduced into a vacuum chamber 13 connected to the ion introduction unit 1.

Although not shown, a vacuum pump is connected to the ion introduction unit 1 and the vacuum chamber 13 so that insides of the ion introduction unit 1 and the vacuum chamber 13 are maintained in a reduced pressure state.

A support member 15 having insulating characteristics and high vibration-absorbing characteristics is provided in the vacuum chamber 13. Further, an outer side surface of the flight tube 14 having a substantially rectangularly tubular or substantially cylindrical shape is at least partially supported by the support member 15 so that the flight tube 14 is supported by the vacuum chamber 13 via the support member 15. Further, an orthogonal acceleration electrode 16 and an ion detector 20 are fixed to the flight tube 14 via a support member (not shown). The orthogonal acceleration electrode 16 is a part of the flight tube 14. On the lower side in the flight tube 14, a reflector 19 composed of a number of circularly annular or rectangularly annular reflective electrodes is arranged. As a result, a reflectron-type flight space FA is provided in the flight tube 14, in which ions are returned by a reflection electric field formed by the reflector 19.

The flight tube 14 is made of metal such as stainless steel, and a predetermined DC voltage is applied to the flight tube 14. Additionally, different DC voltages with reference to the voltage applied to the flight tube 14 are individually applied to the reflective electrodes constituting the reflector 19. As a result, a reflection electric field is formed in the reflector, while the flight space FA except for the reflector has no electric field, no magnetic field, and high vacuum.

After travelling in the positive X direction and being introduced into the orthogonal acceleration electrode 16, ions start their flight with an acceleration in the negative Z direction as a result of a predetermined electric field formed between an extrusion electrode 17 and an extraction electrode 18 with a predetermined timing. The ions emitted from the orthogonal acceleration electrode 16 first fly freely in the flight space FA as indicated by a dashed flight path FP, and then are returned back in the positive Z direction by the reflection electric field formed by the reflector 19 to again fly freely in the flight space FA until the ions reach the ion detector 20.

A velocity of an ion in the flight space depends on a mass-to-charge ratios of the ions. Several types of ions having different mass-to-charge ratios introduced into the flight space FA substantially simultaneously are therefore separated during flight in accordance with their mass-to-charge ratios and reach the ion detector 20 with time differences. A detection signal from the ion detector 20 is input to a control unit 30, and a flight time of each ion is converted into a mass-to-charge ratio to create a mass spectrum. With the mass spectrum, mass analysis is performed.

The control unit 30 includes a CPU 31, a memory 32, and a hard disk 33 and stores program in the memory 32 or the hard disk 33. The control unit 30 can cause the CPU 31 to execute the program to control units of the time-of-flight mass spectrometer 100.

The control unit 30 also instructs the orthogonal acceleration electrode 16 to form a predetermined electric field between the extrusion electrode 17 and the extraction electrode 18 with a predetermined timing.

In order to perform mass analysis with a higher accuracy or a higher resolution, it is preferable that the flight path FP of ions in the flight space FA is longer. A longer flight path FP enables a velocity difference depending on the mass-to-charge ratios of the ions to be measured as a larger time difference.

However, a longer flight path FP increases the flight time of the ion. This results in an increased action time of interaction of electric fields and magnetic fields generated from the ions such as a repulsive force due to charges of the ions. In other words, a space-charge effect has an increased influence.

Hence, in the first embodiment, the measurement process including the flight of the ions in the flight tube 14 and the detection of the ions by the ion detector 20 is performed several times, in which amounts of ions introduced from the ion introduction unit 1 to the flight tube 14 are changed for individual measurement processes. Preceding to each measurement process, the control unit 30 sends a command to the ion transport optical system 12 to change a voltage applied to each electrode constituting the ion transport optical system 12. Accordingly, image-forming conditions of the ion transport optical system 12 are changed to vary a transport efficiency of the ion transport optical system 12, that is, a proportion of ions induced to the orthogonal acceleration electrode 16, which is a part of the flight tube 14, after being emitted from the collision cell 9. In this way, the amount of ions (accumulation state of ions) introduced from the ion introduction unit 1 into the flight tube 14 can be changed for different measurement processes.

Figure 2:
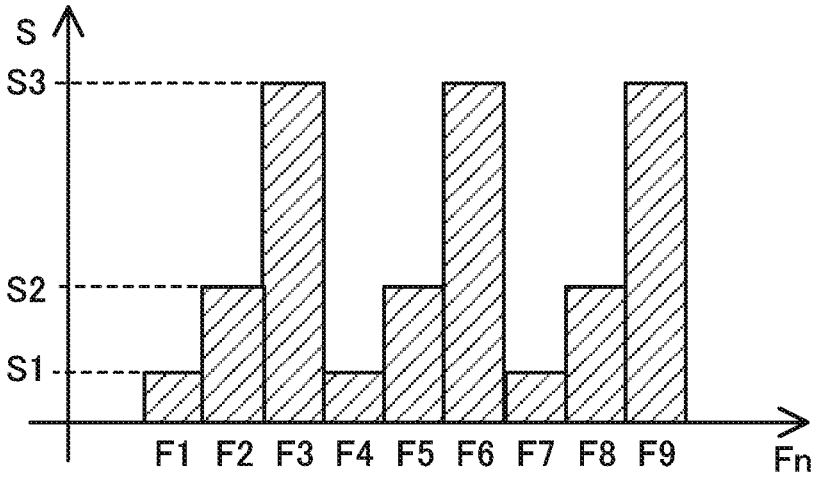
FIG. 2 is a graph showing an example of a transport efficiency of an ion transport optical system for each of a plurality of measurement processes.

FIG. 2 is a graph illustrating an example of the transport efficiency of the ion transport optical system 12 set individually for different measurement processes. The horizontal axis of the graph represents the number of measurements Fn, and the vertical axis of the graph represents the transport efficiency S of the ion transport optical system 12.

In the example illustrated in FIG. 2, nine measurement processes F1 to F9 are performed. The transport efficiency S of the ion transport optical system 12 is set to S1 in three measurement processes F1, F4, F7; S2 in three measurement processes F2, F5, F8; and S3 in three processes F3, F6, F9.

Figure 3:
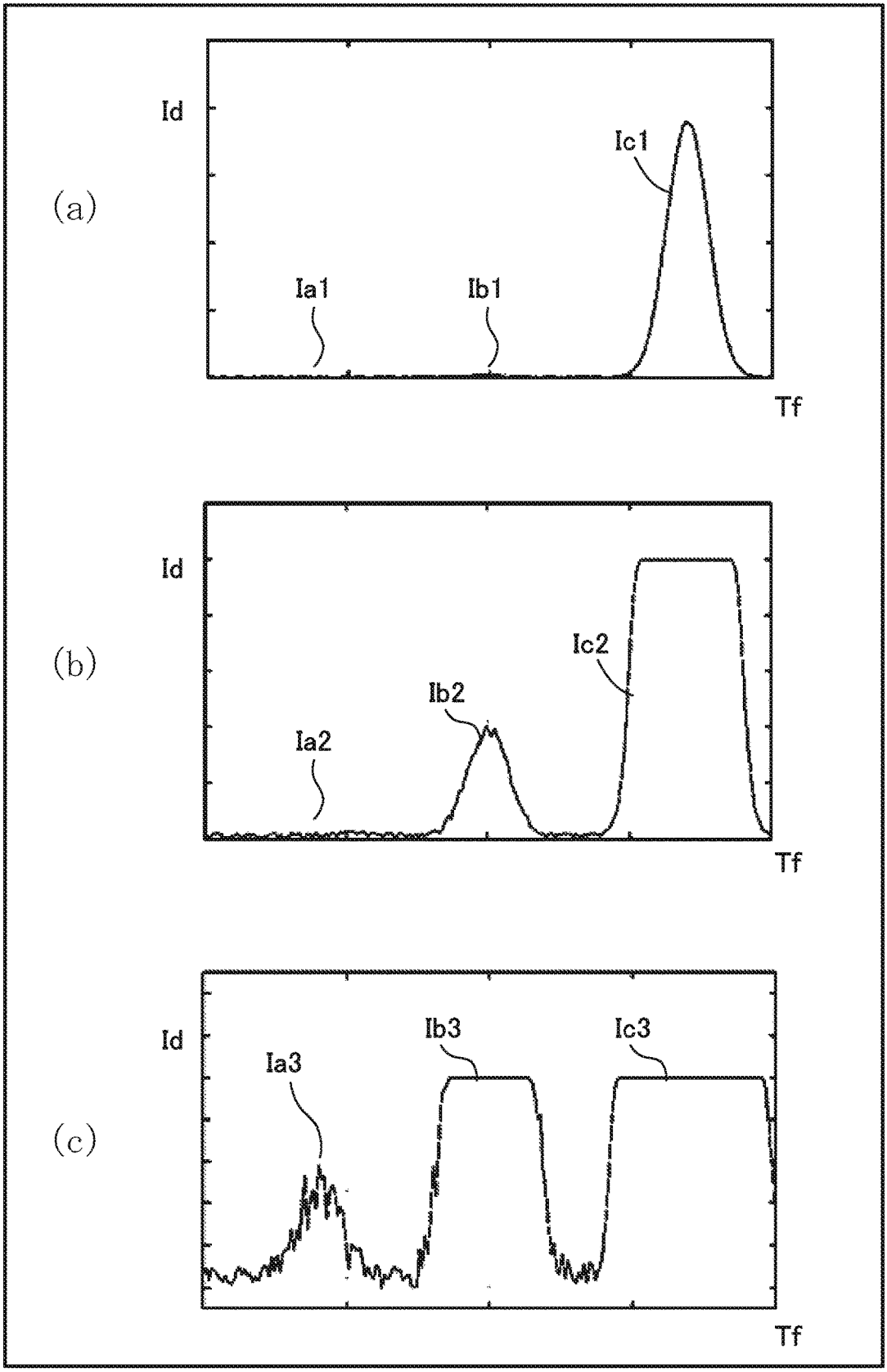
FIG. 3 is a graph showing an example of measurement results.

FIG. 3 is a graph showing an example of measurement results, wherein FIG. 3(*a*) shows a measurement result in a case where the transport efficiency S of the ion transport optical system 12 is low (S1 shown in FIG. 2), FIG. 3(*b*) shows a measurement result in a case where the transport efficiency S of the ion transport optical system 12 is medium (S2 shown in FIG. 2), and FIG. 3(*c*) shows a measurement result in a case where the transport efficiency S of the ion transport optical system 12 is high (S3 shown in FIG. 2).

The horizontal axis of each graph in FIGS. 3(*a*) to 3(*c*) is the flight time Tf of ions, and the vertical axis is the amount of ions detected by the ion detector 20. In the example of FIG. 3, ions to be measured include three types of ions Ia, Ib, and Ic, and differences in the mass-to-charge ratios of the ions cause differences in the flight times Tf of the ions.

In the example of FIG. 3, an abundance ratio of the ion Ia among the ions to be measured is relatively low, an abundance ratio of the ion Ic is relatively high, and an abundance ratio of the ion Ib is moderate.

In the case of the measurement result shown in FIG. 3(*a*), the transport efficiency S of the ion transport optical system 12 is low and thus accumulation states of the ions introduced from the ion introduction unit 1 to the flight tube 14 during the measurement process are also low. Accordingly, a total amount of ions detected in one measurement process is also low. In this condition, a detection result Ia1 of the ions Ia having a low abundance ratio and a detection result Ib1 of the ions Ib become low, so that it is difficult to determine accurate flight times of the ions Ia and Ib due to the measurement noise.

On the other hand, in this condition, the detection result Ic1 of the ion Ic having a high abundance ratio is sufficiently higher than the noise level, and the detection result Ic1 will not be saturated. Thus, the flight time can be accurately determined, that is, the mass-to-charge ratio can be measured with a high accuracy.

At this time, the determination of the flight time is performed by, for example, the control unit 30 calculating a center of gravity of a part having a predetermined level or higher in the detection result Ic1.

In the case of the measurement result shown in FIG. 3(*b*), a detection result Ia2 of the ion Ia having a low abundance ratio is low and is not enough to determine an accurate flight time, because the transport efficiency S of the ion transport optical system 12 is medium.

However, the detection result Ib2 of the ion Ib having a medium abundance ratio is not saturated and is sufficiently higher than the noise level. The flight time of the ion Ib can therefore be accurately determined, that is, the mass-to-charge ratio can be measured with a high accuracy.

However, in the case of the measurement result shown in FIG. 3(*b*), the detection result Ic2 of the ion Ic having a high abundance ratio is saturated. Additionally, the detection result Ic2 is strongly adversely influenced by the space-charge effect because a large amount of ions Ic, which cause the ion detector 20 to be saturated, fly on the flight path FP substantially simultaneously. As a result, it is difficult to measure the mass-to-charge ratio of the ion Ic with a high accuracy using the detection result Ic2.

In the case of the measurement result shown in FIG. 3(*c*), the transport efficiency S of the ion transport optical system 12 is high and thus accumulation states of the ions introduced from the ion introduction unit 1 to the flight tube 14 during the measurement process are also high. Therefore, a sufficient detection result Ia3 can be obtained even for the ion Ia having a low abundance ratio, so that the flight time of the ion Ia can be accurately determined and the mass-to-charge ratio can be measured with a high accuracy.

However, a detection result Ib3 of the ion Ib having a medium abundance ratio and a detection result Ic3 of the ion Ic having a high abundance ratio become saturated. The adverse influence of the space-charge effect by the ions to a degree that the ion detector 20 becomes saturated is the same as in the above-described case. Thus, it is difficult to measure the mass-to-charge ratios of the ion Ib and the ion Ic with a high accuracy from the measurement result shown in FIG. 3(*c*).

In summary, in the plurality of measurement processes described above, the flight time of the ion Ia having a low abundance ratio is calculated based on the detection result Ia3 in the measurement process in which the transport efficiency S of the ion transport optical system 12 is set high (S3), the flight time of the ion Ib having a moderate abundance ratio is calculated based on the detection result Ib2 in the measurement process in which the transport efficiency S of the ion transport optical system 12 is set moderate (S2), and the flight time of the ion Ic having a high abundance ratio is calculated based on the detection result Ic1 in the measurement process in which the transport efficiency S of the ion transport optical system 12 is set low (S1). Thus, it is possible to measure the flight time with a high accuracy and a high resolution, with a reduced adverse influence due to the space-charge effect.

Note that the method of changing accumulation states of ions introduced from the ion introduction unit 1 into the flight tube 14 is not limited to the change in the transport efficiency of the ion transport optical system 12 as described above. The accumulation states of the ions introduced from the ion introduction unit 1 to the flight tube 14 may be changed by changing voltages applied to the ion guide 5 and the ion guide 7 which are other components constituting the ion introduction unit 1 and a voltage applied to the multipole ion guide 10 in the collision cell 9.

Effect of the First Embodiment (1) The time-of-flight mass spectrometer according to the first embodiment described above includes: a flight tube 14; an ion introduction unit 1 that is connected to the flight tube 14; an ion detector 20 that detects an ion flown in the flight tube 14; and a control unit 30 that controls the ion introduction unit 1 and the flight tube 14, wherein: the control unit 30 sequentially changes an accumulation state of the ion to be introduced into the flight tube 14 by the ion introduction unit 1, for a plurality of measurement processes performed repeatedly.

It is thus possible to realize a time-of-flight mass spectrometer having a high accuracy and a high resolution with a reduced adverse influence due to the space-charge effect.

Second Embodiment of Time-of-Flight Mass Spectrometer

A time-of-flight mass spectrometer according to a second embodiment is substantially the same as the time-of-flight mass spectrometer according to the first embodiment described above, only except for the ion introduction unit 1*a*, which is different from the ion introduction unit 1 of the first embodiment.

Figure 4:
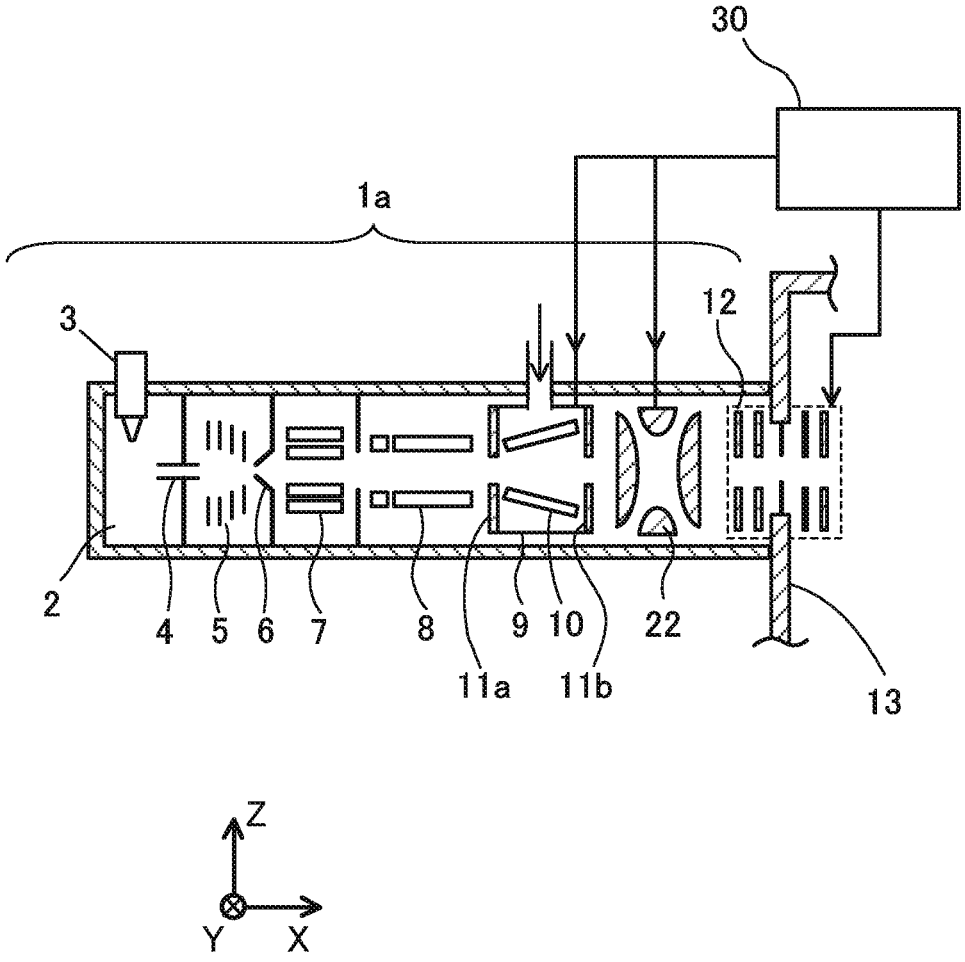
FIG. 4 is a view showing a configuration of an ion introduction unit of a time-of-flight mass spectrometer according to a second embodiment.

FIG. 4 is a view schematically showing the ion introduction unit 1*a* of the time-of-flight mass spectrometer according to the second embodiment. In the ion introduction unit 1*a* of the time-of-flight mass spectrometer according to the second embodiment, an ion trap 22 is provided between the collision cell 9 and the ion transport optical system 12. The ion trap 22 is, for example, a quadrupole ion trap.

In the time-of-flight mass spectrometer according to the second embodiment, various types of product ions generated in the collision cell 9 are accumulated in the ion trap 22. Then, the ions are discharged from the ion trap 22 with a predetermined timing and guided by the ion transport optical system 12 so that the ions are introduced into the orthogonal acceleration electrode 16 which is a part of the flight tube 14. Accumulation and discharge of ions of the ion trap 22 are performed based on a command from the control unit 30.

In the second embodiment, various types of product ions can be accumulated in the ion trap 22 and discharged from the ion trap 22. Thus, the number of ions flying in the flight tube 14 in one measurement process is set larger than that in the first embodiment described above, so that a signal (ion detection amount) to noise increases and a measurement with a high S/N is possible.

First Modification of Second Embodiment

Instead of providing the ion trap 22 described above, the collision cell 9 itself may be provided with an ion trap function. That is, as shown in FIG. 4, for example, the collision cell 9 may be provided with an inlet lens electrode

11*a* and an outlet lens electrode 11*b* to temporarily accumulate product ions generated in the collision cell 9.

Also in this case, based on a command from the control unit 30, voltages for discharging ions are applied to the inlet lens electrode 11*a* and the outlet lens electrode 11*b* with a predetermined timing to discharge the accumulated ions.

FIG. 4 shows the collision cell 9 having an additional effect of ion accumulation, with the ion trap 22. However, the collision cell 9 of the apparatus of FIG. 1 having no ion trap 22 may have an additional effect of ion accumulation.

Effects of Second Embodiment and First Modification (2) In the time-of-flight mass spectrometer according to the second embodiment described above, in addition to a configuration of the time-of-flight mass spectrometer according to the first embodiment described above, the ion introduction unit 1 includes the ion trap 22.

Thus, the number of ions flying in the flight tube 14 in one measurement process can be set larger, so that a measurement with a high S/N is possible.

Note that, in the second embodiment and the first modification, as in the above-described first embodiment, an adverse influence due to the space-charge effect does not occur even if the number of ions flying in the flight tube 14 increases.

Second Modification of Second Embodiment

In a second modification, in addition to the configuration of the second embodiment or the first modification described above, the ion accumulation states of the ions introduced into the orthogonal acceleration electrode 16 of the flight tube 14 are changed by changing the ion accumulation time of the ion trap 22 or the collision cell 9. Additionally, the transport efficiency of the ion introduction unit 1 may be changed by changing voltages applied to the ion transport optical system 12, the ion guide 5, and the ion guide 7 in the ion introduction unit 1.

Effect of Second Modification (3) In the time-of-flight mass spectrometer according to the second modification described above, in addition to the configuration of the time-of-flight mass spectrometer according to the second embodiment described above, the change in the accumulation state is performed by the ion trap 22 or by change in the accumulation time in the collision cell 9. Thus, the ions generated by the ion introduction unit 1 can be efficiently used for measurement.

Third Modification

In a time-of-flight mass spectrometer according to a third modification, in addition to the configuration of the time-of-flight mass spectrometer according to each of the above-described embodiments and modifications, the control unit 30 determines an optimal accumulation state based on results of a plurality of measurement processes performed with different ion accumulation states.

For example, for the measurement result shown in FIG. 3, the control unit 30 determines an accumulation state in which a peak value of an ion detection amount designated by an operator is not saturated and is sufficiently higher than a noise level.

For example, in a case where the operator designates the ion Ib, the detection result Ib2 of the ion Ib shown in FIG. 3(*b*) satisfies this condition and thus the ion transport efficiency S2 of the transport optical system 12 used in measuring the result of FIG. 3(*b*) is determined as an optimal accumulation state.

When the operator designates two types of ions, an optimal accumulation state may be determined for each of the two types of ions.

Note that a determination whether the ion detection amount is sufficiently higher than the noise level may be performed based on whether the ion detection amount is four or more times the standard deviation of the noise level, for example.

The optimal accumulation time may also be determined by the following algorithm.

(1) For the ion having the lowest detection amount among the plurality of detected ions, the control unit 30 may set a transport efficiency S (accumulation state) with which a peak value of the ion detection amount is not saturated and has a level sufficiently higher than that of the noise level, as an optimal accumulation state.

(2) Among the plurality of measurement results, the control unit 30 selects a measurement result in which a time width of an ion detection amount of an ion designated by the operator is within a predetermined time width, and sets a transport efficiency S (accumulation state) with which the measurement result is obtained, as an optimal accumulation state.

A time width of a measured ion detection amount is, for example, a temporary full width at half maximum of the ion detection amount, which substantially corresponds to the time resolution of the time-of-flight mass spectrometer. Therefore, if a time width of a measured ion detection amount is twice or more the time resolution of the spectrometer, for example, the measurement result is presumed to be adversely influenced by the space-charge effect. On the other hand, if a time width of a measured ion detection amount is half or less of the time resolution of the spectrometer, for example, the measurement result is presumed to be influenced by a noise.

Therefore, the optimal accumulation state can be determined by selecting a measurement result in which a time width of an ion detection amount is within a predetermined time width.

(3) The control unit 30 may also determine the optimal accumulation state based on an integral value of the ion detection amounts in results of the plurality of measurement processes. In this case, although it is difficult to determine an optimal accumulation state for each ion based on its detection amount, an amount of calculation required to determine the optimal accumulation state can be reduced so that the optimal accumulation state can be determined in a short time.

(4) The time-of-flight mass spectrometer may include, in addition to the ion detector 20 that detects ions flown in the flight tube 14, a second ion detector 21 that detects ions introduced into the orthogonal acceleration electrode 16, which is a part of the flight tube 14, and passed through the orthogonal acceleration electrode 16. The amount of ions detected by the second ion detector 21 is proportional to the amount of ions detected by the ion detector 20. Therefore, the amount of ions flying in the flight tube 14 can be estimated based on the amount of ions detected by the second ion detector 21. Thus, the control unit 30 may also determine the optimal accumulation state, based on the amount of ions detected by the second ion detector 21 in each of results of the plurality of measurement processes.

The time-of-flight mass spectrometer according to the third modification may further include a display unit 34 and display a result measured in the above-mentioned optimal accumulation state (a graph of the ion detection amount against the flight time, etc.) on the display unit 34. As a result, the operator can view the result measured under the optimal measurement conditions on the display unit 34.

Further, when the above-described optimal accumulation state is determined based on an ion designated by the operator or an ion having the lowest abundance ratio, the detection result may be displayed on the display unit 34 with at least a part of the detection result excluded, the part being different from a part indicating the detection result of the ion used for determining the optimal accumulation state.

Figure 5:
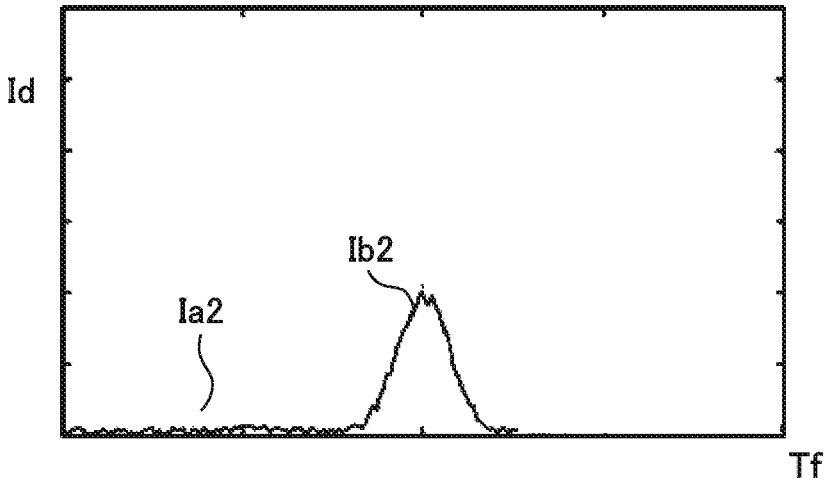
FIG. 5 is a view showing a modification of a measurement result displayed on a display unit.

FIG. 5 shows an example of such a display, basically showing the measurement result shown in FIG. 3(*b*). As described above, among the measurement results shown in FIGS. 3(*a*) to 3(*c*), the result of FIG. 3(*b*) is a measurement result in the optimal accumulation state for the ion Ib when the operator designates the ion Ib, for example. Additionally, in the measurement result of FIG. 3(*b*), the detection result Ic2 of the ion Ic is saturated. Therefore, in the display shown in FIG. 5, the measurement result of FIG. 3(*b*) is displayed with a part representing the detection result Ic2 of the ion Ic excluded, the part being at least a part of the measurement result that is different from the part representing the detection result Ib2 of the ion Ib.

This displaying manner allows unnecessary information to be deleted and only necessary information to be presented for the operator.

Note that, instead of displaying the measurement result on the display unit 34 with at least a part of the measurement result excluded, the part being different from the part representing the ion detection result used for determining the optimal accumulation state as described above or in addition to displaying the measurement result on the display unit 34, the measurement results may be integrated (i.e., stored) in the measurement result database.

The measurement result database may be stored in a storage device (memory 32, hard disk 33, or the like) in the control unit 30 or may be stored in a server 35 connected via a network NW.

Fourth Modification

In a time-of-flight mass spectrometer according to a fourth modification, in addition to the configuration of the time-of-flight mass spectrometer according to the third modification described above, once the above-described optimal accumulation state is determined, the determined optimal accumulation state is set more frequently than other accumulation states in a plurality of subsequent measurement processes.

Figure 6:
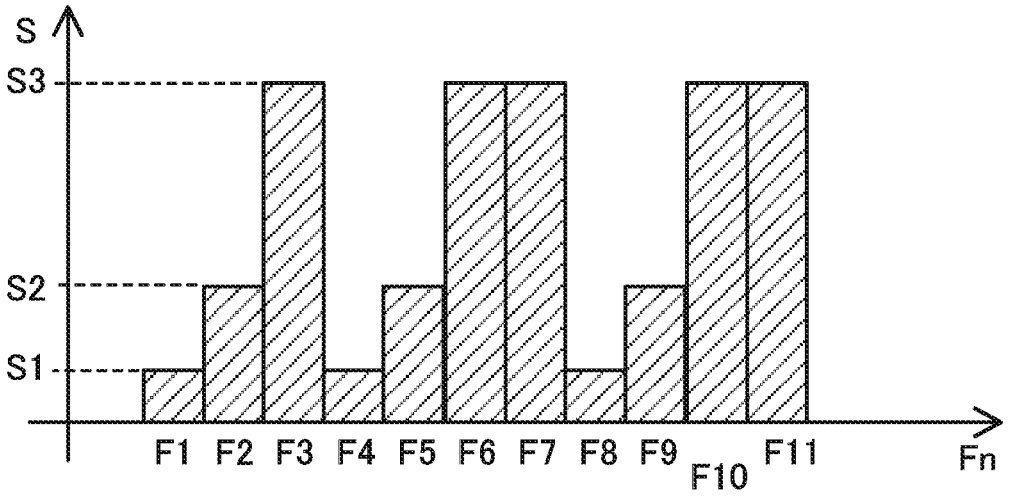
FIG. 6 shows another example of a transport efficiency of an ion transport optical system for each of a plurality of measurements.

FIG. 6 is a graph showing an example of a setting of the accumulation state (transport efficiency S of the ion transport optical system 12) in the fourth modification. This figure is a graph similar to FIG. 2 described above.

In FIG. 6, in first three measurement processes (F1 to F3), the transport efficiency S is sequentially set to S1, S2, and S3 in the same manner as in the above-described first embodiment. Based on these three measurement processes, the control unit 30 determines that the transport efficiency S3 is in the optimal accumulation state. Then, in a large number of subsequent measurement processes, the control unit 30 performs measurements by setting the transport efficiency S3, which is the optimal accumulation state, more frequently than the other transport efficiencies S1 and S2. In other words, as an example, the measurement with the transport efficiency S1 is performed twice in the measurement processes F4 and F8, and the measurement with the transport efficiency S2 twice in the measurement processes F5 and F9, while the measurement with the transport efficiency S3, which is in the optimal accumulation state, is performed four times in the measurement processes F6, F7, F10, and F11.

Effect of Fourth Modification (4) In the time-of-flight mass spectrometer according to the fourth modification described above, in addition to the configuration of the time-of-flight mass spectrometer according to the third modification described above, once the above-described optimal accumulation state is determined, the determined optimal accumulation state is set more frequently than other accumulation states in a plurality of subsequent measurement processes.

By performing the measurement in the optimal accumulation state more frequently than measurements in other accumulation states, a measurement accuracy can be improved for an ion designated by the operator or for an ion having a low abundance ratio which tends to result in a lower measurement accuracy.

Embodiment of Program

In each of the above-described embodiments and modifications, program for realizing the above-described function of the time-of-flight mass spectrometer 100 may be recorded in a computer-readable recording medium, and the program recorded in the recording medium may be loaded and executed by a computer system. Here, the "computer system" includes an OS (Operating System) and hardware of peripheral devices. The "computer-readable recording medium" refers to a portable recording medium such as a flexible disk, a magneto-optical disk, an optical disk, or a memory card, or a storage device such as a hard disk integrated in a computer system. Furthermore, the "computer-readable recording medium" may include a medium dynamically holding program in a short time, such as a transmission line in a case where program is transmitted via a network (e.g., the Internet) or a communication line (e.g., a telephone line); and a medium holding program for a certain period of time, such as a volatile memory in a computer system that is a server or a client in that case. Further, the above-described program may be intended to realize a part of the above-described functions, or even realize a part of the above-described functions in combination of program already recorded in a computer system.

Further, the program described above may be provided via a recording medium such as a CD-ROM or a data signal such as the Internet. For example, the control unit 30 including the CPU 31, the memory 32, and the hard disk 33 in FIG. 1 is supplied with program via a CD-ROM. The control unit 30 also has a connection function with the network NW. The server 35 connected to the network also functions as a server computer that provides the above-described program, and transfers the program to a recording medium such as the hard disk 33. That is, the program is carried by a carrier wave as a data signal and transmitted via the network NW. In this way, the program can be supplied as various forms of computer readable computer program products such as a recording medium and a carrier wave.

Figure 7:
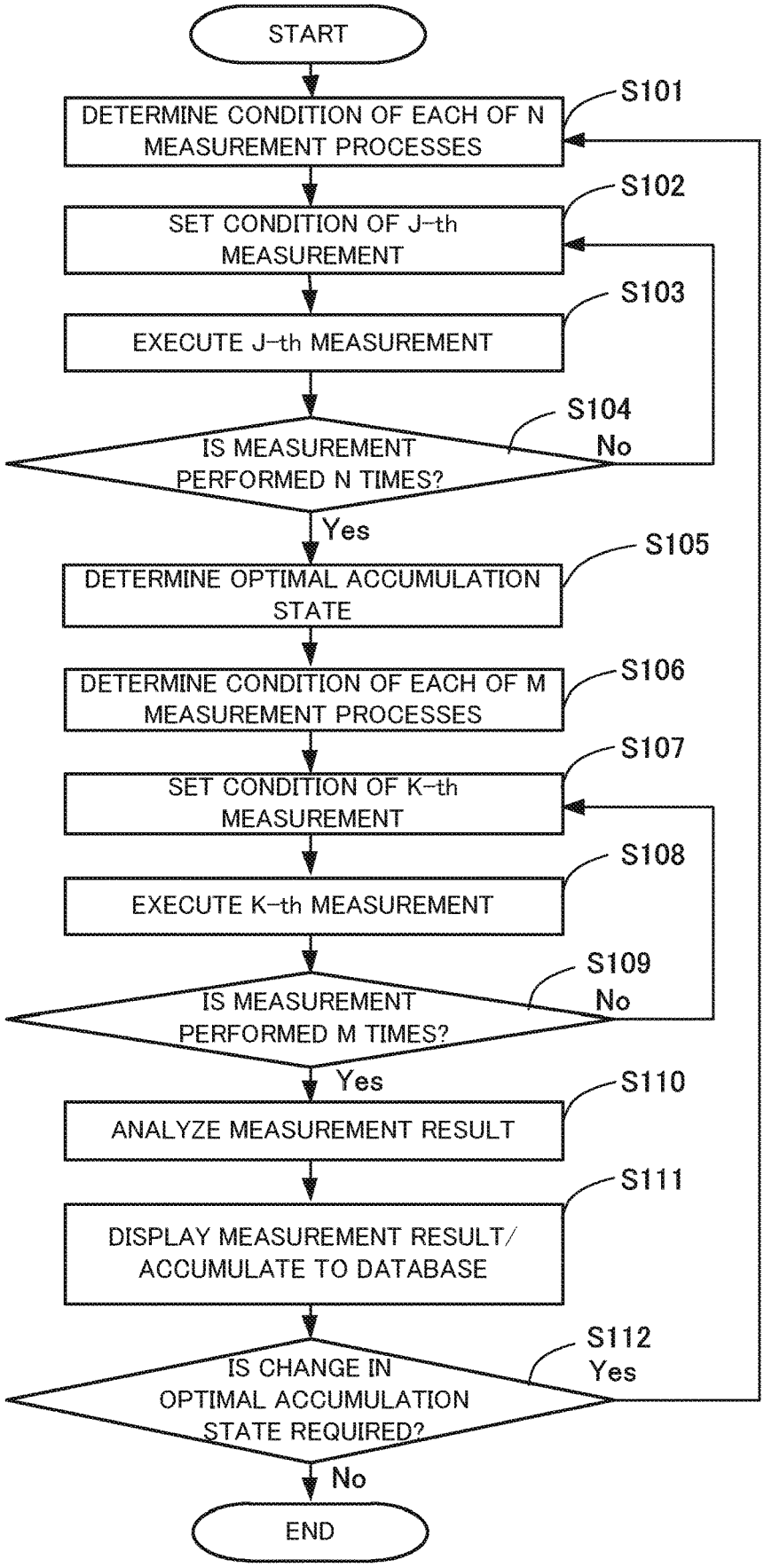
FIG. 7 shows an example of a flowchart executed by a software embodiment.

FIG. 7 shows a flowchart as an example, in which program for controlling the time-of-flight mass spectrometer 100 of the above-described fourth modification is executed by the CPU 31 to control the ion introduction unit 1, the flight tube 14, and the control unit 30 of the time-of-flight mass spectrometer 100.

First, in step S101, measurement conditions such as ion accumulation states (such as the transport efficiency S of the ion transport optical system 12 of the ion introduction unit 1) of the first N measurement processes (N is a natural number, for example 3) are decided.

In step S102, the program controls the control unit 30 to set the transport efficiency S of the ion transport optical system 12 of the ion introduction unit 1 and the accumulation time of the ion trap 22 for a J-th measurement process (J is one or higher and is equal to or less than N). Then, in step S103, the program controls the control unit 30 to apply a voltage to the orthogonal acceleration electrode 16 and perform the J-th measurement process.

In step S104, it is determined whether the measurement process has been performed N times. If the measurement process has been performed N times, the program proceeds to step S105. If the measurement process has not been performed N times, the process returns to step S102.

In step S105, the program controls the control unit 30 to determine the optimal accumulation state from the results of the above-described N measurement processes. The method of determining the optimal accumulation state is the same as described above. Then, in step S106, measurement conditions of the subsequent M measurement processes (M is a natural number) are determined so that the measurement in the optimal accumulation state determined in step S105 is performed more frequently than other accumulation states.

In step S107, the program controls the control unit 30 to set the transport efficiency S of the ion transport optical system 12 of the ion introduction unit 1 and the accumulation time of the ion trap 22 for a K-th measurement process (K is one or higher and is equal to or less than M). Then, in step S108, the program controls the control unit 30 to apply a voltage to the orthogonal acceleration electrode 16 and perform the K-th measurement process.

In step S109, it is determined whether the measurement process has been performed M times. If the measurement process has been performed M times, the program proceeds to step S110. If measurement process has not been performed M times, the process returns to step S107.

In step S110, the program causes the control unit 30 to perform an analysis of a measurement result such as a calculation of a mass-to-charge ratio of each detected ion, based on the result of the measurement described above. Further, as described above, the program performs processing for removing an unnecessary part (part different from the part corresponding to the designated ion) from the measurement result representing the relationship between the amount of detected ion and the flight time, as required.

In step S111, a measurement result measured and subjected to analysis and various types of processing is displayed on the display unit 34 or accumulated in a database.

In step S112, based on the measurement result, and the measurement result subjected to analysis and various types of processing, it is determined whether the optimal accumulation state determined in step S105 is appropriate, that is, whether it is necessary to change the optimal accumulation state. Then, if it is determined that the change is necessary, the program proceeds to step S101 and changes each of the N measurement conditions. Then, the processes after step S101 are preformed again. If it is determined that the change is unnecessary, the measurement ends.

Note that it is not necessarily required to execute all steps of the flowchart shown in FIG. 7. For example, performance of step S106 to step S109 may be omitted.

Although various embodiments and modifications have been described above, the present invention is not limited to these. Additionally, each embodiment may be applied alone or in combination. Other aspects considered within the scope of the technical idea of the present invention are also included within the scope of the present invention.

REFERENCE SIGNS LIST

100 . . . time-of-flight mass spectrometer, 1, 1*a* . . . ion introduction unit, 2 . . . ionization chamber, 3 . . . ESI spray, 4 . . . heating capillary, 5, 7 . . . ion guide, 6 . . . skimmer, 8 . . . quadrupole mass filter, 9 . . . collision cell, 10 . . . electrode, 12 . . . ion transport optical system, 13 . . . vacuum chamber (TOF unit), 14 . . . flight tube, 15 . . . support member, 16 . . . orthogonal acceleration electrode, 17 . . . extrusion electrode, 18 . . . extraction electrode, 20 . . . ion detector, 21 . . . second ion detector, 22 . . . quadrupole ion trap, FA . . . flight space, FP . . . flight path, 19 . . . reflector, 30 . . . control unit, 31 . . . CPU, 32 . . . memory, 33 . . . hard disk, 34 . . . display unit, 35 . . . server

The invention claimed is:

1. A time-of-flight mass spectrometer, comprising:

a flight tube;

an ion introduction unit that is connected to the flight tube;

an ion detector that detects an ion flown in the flight tube; and a control unit that controls the ion introduction unit and the flight tube, wherein:

the control unit sequentially changes an amount of ions to be introduced into the flight tube by the ion introduction unit, for a plurality of measurement processes performed repeatedly, and the control unit calculates a flight time of an ion having a relatively low abundance ratio based on a detection result in one of the plurality of measurement processes in which the amount of ions is set relatively high, and calculates a flight time of an ion having a relatively high abundance ratio based on a detection result in one of the plurality of measurement processes in which the amount of ions is set relatively low.

2. The time-of-flight mass spectrometer according to claim 1, wherein:

the ion introduction unit has an ion trap.

3. The time-of-flight mass spectrometer according to claim 2, wherein:

changing the amount of ions is performed by changing an accumulation time in the ion trap.

4. The time-of-flight mass spectrometer according to claim 1, wherein:

the control unit determines an optimal amount of ions among a plurality of amounts of ions based on results of the plurality of measurement processes.

5. The time-of-flight mass spectrometer according to claim 4, wherein:

after determining the optimal amount of ions, the control unit sets the optimal amount of ions more frequently than other amounts of ions in changing the amount of ions.

6. The time-of-flight mass spectrometer according to claim 4, wherein:

the control unit determines the optimal amount of ions based on peak intensities of at least one type of ion detection result in the results of the plurality of measurement processes.

7. The time-of-flight mass spectrometer according to claim 4, wherein:

the control unit determines the optimal amount of ions based on time widths of at least one type of ion detection result in the results of the plurality of measurement processes.

8. The time-of-flight mass spectrometer according to claim 4, wherein:

the control unit determines the optimal amount of ions based on integral values of ion detection amounts in the results of the plurality of measurement processes.

9. The time-of-flight mass spectrometer according to claim 4, comprising:

a second ion detector that detects an amount of ions introduced into the flight tube, wherein:

the control unit determines the optimal amount of ions based on integral values of ion detection amounts by the second ion detector in the results of the plurality of measurement processes.

10. The time-of-flight mass spectrometer according to claim 4, wherein:

the control unit displays a result measured in the optimal amount of ions on a display unit.

11. The time-of-flight mass spectrometer according to claim 6, wherein:

the control unit displays a measurement result on a display unit, with at least a part of the measurement result excluded, the part being different from the ion detection result used for determining the optimal amount of ions, or accumulates the measurement result in a measurement result database.

12. A non-transitory computer-readable recording medium on which is recorded a program that controls a time-of-flight mass spectrometer, the program being configured to cause a data processor including a computer to perform:

a control of sequentially changing amount of ions introduced from an ion introduction unit into a flight tube for a plurality of measurement processes performed repeatedly;

a control of calculating a flight time of an ion having a relatively low abundance ratio based on a detection result in one of the plurality of measurement processes in which the amount of ions is set relatively high; and a control of calculating a flight time of an ion having a relatively high abundance ratio based on a detection result in one of the plurality of measurement processes in which the amount of ions is set relatively low.

13. The non-transitory computer-readable recording medium according to claim 12, wherein:

the program causes the data processor to determine an optimal amount of ions among a plurality of amounts of ions based on results of the plurality of measurement processes.

* * * * *